US005697425A

United States Patent [19]

Nanba et al.

[11] Patent Number: 5,697,425

[45] Date of Patent: Dec. 16, 1997

[54] METHOD OF PRODUCING THIN CAST SHEET THROUGH CONTINUOUS CASTING

[75] Inventors: Akihiko Nanba; Chisato Yoshida, both of Chiba; Takaharu Moriya, Kure; Naotsugu Yoshida, Amagasaki; Yasuyuki Murata, Toyohashi; Kazutoshi Hironaka, Kawasaki; Mineo Muraki; Ujihiro Nishiike, both of Kurashiki, all of Japan

[73] Assignee: Rheo-Technology, Ltd., Japan

[21] Appl. No.: 433,480

[22] PCT Filed: Aug. 9, 1994

[86] PCT No.: PCT/JP94/01315

§ 371 Date: May 11, 1995

§ 102(e) Date: May 11, 1995

[87] PCT Pub. No.: WO95/07780

PCT Pub. Date: Mar. 23, 1995

[30] Foreign Application Priority Data

Sep. 16, 1993 [JP] Japan ..... 5-230374
Sep. 16, 1993 [JP] Japan ..... 5-252125

[51] Int. Cl.[6] ..... B22D 11/06; B22D 27/02; B22D 27/08; B22D 35/06

[52] U.S. Cl. ..... 164/468; 164/71.1; 164/480; 164/488; 164/900; 222/593

[58] Field of Search ..... 164/71.1, 900, 164/480, 428, 488, 468; 222/593

[56] References Cited

FOREIGN PATENT DOCUMENTS

| | | | |
|---|---|---|---|
| 56-62671 | 5/1981 | Japan | 222/593 |
| 64-27751 | 1/1989 | Japan | 164/900 |
| 64-40147 | 2/1989 | Japan | 164/428 |
| 1-170564 | 7/1989 | Japan | 222/593 |
| 2-89541 | 3/1990 | Japan | 164/900 |
| 745427 | 2/1956 | United Kingdom | 164/488 |

*Primary Examiner*—Kuang Y. Lin
*Attorney, Agent, or Firm*—Austin R. Miller

[57] ABSTRACT

Thin cast sheets having an excellent quality are obtained by continuous casting in which a semi-solidified metal slurry is fed from a continuous production device of the semi-solidified metal slurry through a discharge nozzle provided with means for heating the nozzle itself into a twin roll type continuous strip caster, at where the slurry is rapidly quenched and solidified to fine a structure and dispersion of precipitate.

13 Claims, 6 Drawing Sheets

200μm

200μm

METHOD OF PRODUCING THIN CAST SHEET THROUGH CONTINUOUS CASTING

TECHNICAL FIELD

This invention relates to a method of producing thin cast sheets (band-shaped) through continuous casting of a semi-solidified metal (alloy) slurry as a raw material for high-quality and low-cost sheets in which the formation of fine grain structure and the fine dispersion are conducted to mitigate the segregation and surface cracking and improve the workability.

BACKGROUND ART

A satisfactory technique of continuously casting semi-solidified metal slurry has not yet established in the art.

The primary reason is due to the fact that the semi-solidified metal slurry is solidified by slight losses of heat.

That is, the temperature of the semi-solidified metal slurry at the production step of the semi-solidified metal slurry is naturally lower than a liquidus line of the metal, so that when heat of the semi-solidified metal slurry is reduced by contacting the slurry with an inner wall surface of a discharging device (e.g. discharge nozzle) during the discharge of the semi-solidified metal slurry, even if the heat loss is slight, there is caused adhesion of high melting point component (e.g. $Al_2O_3$ or the like) in the semi-solidified metal slurry to the wall surface of the device, as well as solidification adhesion of the semi-solidified metal slurry itself to the wall surface and the like. Thus, a so-called, solidification shell adheres to the wall surface.

In the discharging device for the semi-solidified metal slurry, therefore, there is a basic problem that it is apt to cause difficulty in controlling the discharge amount, clogging of the nozzle and the like due to the adhesion of the solidification shell. For this end, it is important to solve this problem in order to conduct the continuous casting by supplying the semi-solidified metal slurry into a continuous casting machine through the discharge nozzle.

In general, an immersion nozzle is used to supply molten metal from a tundish into a continuously casting mold.

Regarding the immersion nozzle, in order to avoid precipitation adhesion of the high melting point component to the inner wall surface of the nozzle during the introduction of molten metal or solidification adhesion of molten metal itself to the wall surface based on the loss of heat through the nozzle, or so-called clogging trouble of the nozzle runner due to the adhesion of solidification shell, there are known, for example, a countermeasure wherein an electric heating body is inserted into the nozzle to preheat the nozzle from its inner side as disclosed in JP-A-63-286268 (method of heating tundish nozzle), a countermeasure of preheating the nozzle from its inner side through a burner, a countermeasure wherein the nozzle body is made from an electrically conductive refractory material and a current is directly supplied to heat the nozzle as disclosed in JP-B-63-24788, a countermeasure wherein an induction heating coil is arranged around the outer periphery of the nozzle to heat molten metal passing through the nozzle by induction heating, and the like.

However, it has been confirmed that all of the above countermeasures are unsuitable when the above immersion nozzle for molten metal is used as a discharge nozzle for the semi-solidified metal.

That is, in case of preheating with the electric heating body or the burner, it is practically difficult to raise the preheating temperature up to a temperature exceeding 1000° C. at the inner wall surface of the nozzle and the heating can not be conducted during the passing of the semi-solidified metal through the nozzle. In the actual operation, therefore, the temperature of the inner wall surface of the nozzle specially preheated drops during the discharge of the semi-solidified metal before the completion of the discharge and a part of the semi-solidified metal passing through the nozzle forms a solidification shell and adhered to the wall surface by due to heat loss through the wall surface to thereby cause the clogging of the nozzle.

In the case of directly supplying the current to heat the nozzle, there are problems that the risk of electric leakage is high due to the embedment of a special electrode in the nozzle and the satisfactory heating temperature can not be obtained only by heat conduction of the nozzle itself because the electrode can not be embedded in the top portion of the nozzle to be immersed.

Since the induction heating system in which the induction heating coil is arranged around the outer periphery of the nozzle is mainly to reheat molten metal passing through the nozzle, the applied frequency presently adopted is less than 10 kHz, so that the induction current is absorbed by the semi-solidified metal having a conductivity higher than that of the nozzle body during the passing of the semi-solidified metal through the nozzle and hence it has been confirmed that the effect of heating the nozzle body to prevent the loss of heat from the semi-solidified metal can not be expected.

Furthermore, the reheating of the semi-solidified metal lowers the solid fraction and incorporates fine primary solid particles to degrade the quality. This system is also unsuitable from this point.

On the other hand, metal (alloy) materials used as a raw material for ingots or slabs cast from their melts may have inevitable problems in view of the production, quality and economical reasons. For example, there are austenitic stainless steel, boron-containing austenitic stainless steel, ferritic stainless steel, martensitic stainless steel, silicon steel for electromagnetic sheets, phosphor bronze alloy, high-Sn copper alloy for superconducting material and the like.

Each of these metal materials has the following problems.

In general, the austenitic stainless steel is large in the susceptibility to cracking in the hot working as compared with the ferritic stainless steel. Therefore, the thin sheet of this steel is commonly produced by blooming a steel ingot into a slab, removing cracks generated on the surface of the slab through grinding work, and then subjecting the slab to hot rolling and cold rolling. However, the work of removing the cracks from the slab surface disadvantageously and largely decreases the product yield, so that it is actually a remarkable load in view of the operability.

In order to solve the above problem, it is attempted to directly produce a cast sheet corresponding to the slab by continuous casting. Even when this process is applied, it is difficult to avoid the surface cracking, so that the work of removing the cracks through grinding is still necessary.

The boron-containing austenitic stainless steel is characterized by having a large thermal neutron absorbability of B included and is excellent in corrosion resistance, so that it is favorable as a thermal neutron shielding material.

However, B in the steel reacts with Fe or Cr to form a boride as an intermetallic compound and the resulting boride considerably degrades the hot workability, so that there is a problem that it is very difficult to produce steel sheets through hot rolling as the B content increases. It is desired to solve this problem.

As a technique for solving the above problem, there is proposed and disclosed a countermeasure for improving the hot workability by adjusting a ratio of Al and N contents in the boron-containing austenitic stainless steel, for example, in JP-A-57-45464 (boron-containing austenite stainless steel for atomic reactor having an excellent hot workability).

Furthermore, there is proposed and disclosed a countermeasure for improving the hot workability by adding V to the boron-containing stainless steel in JP-A-55-89459 (boron-containing stainless steel having excellent corrosion resistance and workability).

However, the improvement of hot workability by the addition of the alloying component is hardly expected and it is difficult to produce the boron-containing austenitic stainless steel sheet by usual hot rolling.

Moreover, JP-A-4-236716 (method of producing hot rolled sheets of B-containing austenitic stainless steel) proposes and discloses a hot rolling method wherein the temperature and draft in the blooming are specified to define the heating temperature of the resulting bloomed slab, rolling end temperature and final finish rolling rate as a method of preventing hot rolled cracks of the boron-containing austenitic stainless steel.

In this method, however, coarse boride is produced in the solidification of steel ingot, so that the effect of preventing the hot rolled cracks can be expected only in a low B-containing steel in which the B content is not more than 1.2 wt %, which is not sufficiently satisfied.

In the ferritic stainless steel, the columnar crystal is apt to be grown at the solidification step. When the cast slab having a grown structure of such a columnar crystal is used as a raw material and rolled and then subjected to a forming work with a press or the like, uneven defects known as ridging are created on the surface of the resulting thin steel sheet.

The occurrence of the ridging results from the fact that the columnar crystal grown from the surface of the cast sheet toward its central portion forms a texture having a strong orientation accompanied with the hot rolling and cold rolling.

As a method of preventing the occurrence of ridging, there is used a method wherein the solidification structure is improved by decreasing the casting temperature in the continuous casting or by electromagnetic agitation of molten metal, a method of controlling the hot rolling conditions or heat treating conditions, and the like.

In the cast sheet of about 200 mm in thickness obtained by the continuous casting, however, it is difficult to sufficiently prevent the growth of columnar crystal even by the adjustment of the casting temperature or the use of the electromagnetic agitation of molten metal because the solidification rate is slow. Furthermore, the occurrence of ridging can not be prevented by the subsequent control of the rolling conditions or the heat treating conditions.

On the other hand, there is proposed a method of preventing the occurrence of the ridging by thinning the thickness of the cast sheet to fine the solidification structure.

For instance, JP-A-62-54017 (method of producing thin cast sheets of Cr-based stainless steel) proposes and discloses a method wherein the Cr-based stainless steel is cast into a thin sheet and then subjected to cooling, working and heat treatment to prevent the occurrence of the ridging.

Furthermore, JP-A-62-176649 (method of producing thin sheet strip of no-roping ferritic stainless steel) proposes and discloses a method wherein a thin sheet strip of not more than 5 mm in thickness is cast from molten metal by single roll or twin roll process and then subjected to annealing, cold rolling and annealing to prevent the occurrence of roping (ridging).

However, the method of thinning the thickness of the cast sheet to control the occurrence of the ridging is effective in a point that the solidification rate is made large, but can not completely control the growth of columnar crystal because molten metal supplied has a superheat (temperature difference between molten metal temperature and liquidus line). Moreover, the reduction ratio is decreased and the breakage of solidification structure is insufficient, so that special cooling conditions, rolling conditions and heat treating conditions are required.

In the martensitic stainless steel, particularly high carbon Cr martensite, primary carbide is precipitated in net form owing to the hyper-eutectoid steel. In the conventional continuous cast slab, coarse carbide is unhomogeneously precipitated accompanied with macrosegregation to degrade the product quality. For this end, a countermeasure on the formation of fine carbide is considered at the working stage, but is not yet sufficient.

As to the silicon steel, there is used a so-called molten metal process wherein molten metal is cast through an ingot-forming mold or a continuous casting mold.

Recently, there is developed a so-called rapidly quenching process wherein a very thin silicon steel sheet (thin ribbon) is produced by rendering into amorphous state by means of a water-cooled single roll.

When the cast ingot or cast slab is produced by the above molten metal process, the columnar crystal grows from the surface of the cast body toward its center to form a giant crystal as a solidification structure. As a result, component segregation is caused in the central portion of the cast body by the growth of the columnar crystal.

In the grain oriented silicon steel, there is adopted a method of precipitating fine MnS, MnSe and the like as an inhibitor on movement of crystal grain boundary in the secondary recrystallization to improve the selectivity of crystal growing orientation. However, if the aforementioned component segregation is caused, the precipitated MnS, MnSe and the like becomes large in the segregated portion, which undesirably lowers the effect as the inhibitor. As a countermeasure, MnS, MnSe and the like are again soluted to finely reprecipitate them before the hot rolling, in which the soaking temperature in the solution treatment is about 1400° C. considerably higher than that of the other steels. Therefore, there are caused many problems such as accumulation of oxide scale in the heating furnace, loss of the furnace structure, increase of energy loss and the like.

In the rapidly quenching method, it is required to include a great amount of specific component (B or the like) for the formation of amorphous state and there are still problems in the mass production and stable operation, so that only a part of product is actually industrialized.

On the other hand, the larger the Si content, the better the magnetic properties such as maximized permeability and the like. The properties are maximum at 6.5 wt %. However, the elongation rapidly decreases when the Si content is not less than 2.5 wt % and is substantially zero at 5 wt %. Thus, as the Si content increases, brittleness rapidly increases so that it is difficult to conduct the cold rolling of silicon steel containing Si of not less than about 3.5 wt %, and also the hot rolling is impossible at the content exceeding 5 wt %. Therefore, the Si content of mass-produced silicon steel is restricted to not more than 3.5 wt % except for only a part of silicon steel produced by special process.

In general, the phosphor bronze alloy is apt to cause segregation at the solidification stage, and Sn rich layer called as "tin sweat" is apt to be formed on a surface of a cast ingot. And also, δ-phase as Cu—Sn intermetallic compound is formed in this rich layer, which results in work cracking in the subsequent work.

For this end, the phosphor bronze alloy plate of not less than 15 mm in thickness is usually produced by the continuous casting, and thereafter subjected to surface grinding by about 2.5 mm on every of the plate to remove tin sweat portion and then introduced into steps of soaking treatment→cold rolling.

In the conventional method of subjecting the continuously cast plate of phosphor bronze alloy to the grinding treatment, however, the grinding margin is 5 mm in total of front and back surfaces, so that the product yield largely lowers and the productivity is lowered in view of the operation step.

In order to avoid "tin sweat" as a problem in the production of this type of the sheet, it is known that it is effective to control solidification segregation by rapidly quenching molten metal in the continuous casting. Even if the solidification rate is high, the structure forms a dendritic columnar crystal structure extending from the surface layer of the cast sheet toward its central portion, so that the occurrence of tin sweat and the formation of δ-phase are inevitable at this region and hence the grinding treatment for removing this portion is still necessary.

The high-Sn copper alloy having Sn content of not less than 8 wt % is used in the production of $Nb_3Sn$ superconducting material.

In the production of very fine multicore $Nb_3Sn$ superconducting wire, it is said that the Sn content in Cu—Sn alloy used as a matrix alloy is preferable to be large in order to shorten the diffusion distance and improve the performances. However, when the Sn content is not less than 8 wt %, the segregation is conspicuous and the grain boundary becomes brittle due to the precipitation of δ-phase, which becomes near to be impossible in the hot rolling and cold rolling.

SUMMARY OF THE INVENTION

It is an object of the invention to provide a casting method for thin cast sheets capable of continuously casting semi-solidified metal slurry into a thin cast sheet, particularly a method of producing thin cast sheets as a thin sheet having high quality and low cost by continuous casting of semi-solidified metal slurry.

The purport and construction of the invention advantageously achieving the above object are as follows.

1. The invention relates to a method of producing thin cast sheets by continuous casting which comprises: continuously feeding molten metal into an upper port of a continuous production device of a semi-solidified metal slurry, at where molten metal is agitated under cooling to form a semi-solidified metal slurry of a solid-liquid mixed phase suspending fine non-dendritic primary solid particles therein; and feeding the semi-solidified metal slurry through a discharge nozzle arranged at a bottom of the continuous production device of a semi-solidified metal slurry and provided with means for heating the nozzle itself into a twin roll type continuous strip caster, at where the slurry is rapidly quenched and cast to form a line structure and to disperse of precipitate (first invention).
2. The invention also relates to a method of producing thin cast sheets by continuous casting as claimed in the first invention, wherein the agitation is an electromagnetic agitating system (second invention).
3. The invention further relates to a method of producing thin cast sheets by continuous casting as claimed in the first invention, wherein the agitation is an agitator rotating system (third invention).
4. The invention also relates to a method of producing thin cast sheets by continuous casting as claimed in the first invention, second invention or third invention, wherein the means for heating the discharge nozzle is a high frequency induction heating system having a frequency of 40 kHz–200 kHz (fourth invention).
5. The invention further relates to a method of producing thin cast sheets by continuous casting as claimed in the fourth invention, wherein the discharge nozzle is made from alumina graphite having a specific resistance of 5000 μΩ·cm–12000 μΩ·cm (fifth invention).
6. The invention also relates to a method of producing thin cast sheets by continuous casting as claimed in the first invention, second invention or third invention, wherein the means for heating the discharge nozzle is a heating system with an electric resistance heater (sixth invention).
7. The invention further relates to a method of producing thin cast sheets by continuous casting as claimed in anyone of the first invention to the sixth invention, wherein the semi-solidified metal slurry fed into the twin roll type continuous strip caster has a solid fraction of 0.01–0.40 (seventh invention).
8. The invention also relates to a method of producing thin cast sheets by continuous casting as claimed in anyone of the first invention to the seventh invention, wherein the thin cast sheet has a thickness of not more than 10 mm (eighth invention).
9. The invention further relates to a method of producing thin cast sheets by continuous casting as claimed in anyone of the first invention to the eighth invention, wherein molten metal is an austenitic stainless steel and the casting is carried out to fine dispersion of P and S (ninth invention).
10. The invention also relates to a method of producing thin cast sheets by continuous casting as claimed in anyone of the first invention to the eighth invention, wherein molten metal is a boron-containing austenitic stainless steel containing B: 0.5–4.0 wt % and the casting is carried out to fine dispersion of P, S and boride (tenth invention).
11. The invention further relates to a method of producing thin cast sheets by continuous casting as claimed in anyone of the first invention to the eighth invention, wherein molten metal is a ferritic stainless steel and the casting is carried out to prevent the formation of columnar crystal (eleventh invention).
12. The invention also relates to a method of producing thin cast sheets by continuous casting as claimed in anyone of the first invention to the eighth invention, wherein molten metal is a martensitic stainless steel and the casting is carried out to fine dispersion of carbide (twelfth invention).
13. The invention further relates to a method of producing thin cast sheets by continuous casting as claimed in anyone of the first invention to the eighth invention, wherein molten metal is a silicon steel containing Si: 3.0–6.5 wt % and Mn: not more than 2.5 mass % and the casting is carried out to fine structure and dispersion of Mn compound (thirteenth invention).
14. The invention also relates to a method of producing thin cast sheets by continuous casting as claimed in anyone of the first invention to the eighth invention, wherein molten metal is a phosphor bronze alloy containing Sn: 3.5–9.0 wt % and P: 0.03–0.35 wt % and the casting is carried out to prevent formation of columnar crystal and fine structure (fourteenth invention).

15. The invention further relates to a method of producing thin cast sheets by continuous casting as claimed in anyone of the first invention to the eighth invention, wherein molten metal is a high Sn copper alloy containing Sn: 8–20 wt % and the casting is carried out to prevent formation of columnar crystal and fine structure (fifteenth invention).

The function and effect of the invention will be described below.

According to the invention, molten metal is agitated under cooling to continuously produce a semi-solidified metal slurry of a solid-liquid mixed phase suspending fine non-dendritic primary solid particles therein, which is fed through the discharge nozzle provided with the means for heating the nozzle itself into the twin roll type continuous strip caster to conduct the rapid quenching and continuous casting to form a metal sheet having a fine structure and the dispersed precipitate, whereby the thin cast sheet having a good quality is produced (first invention).

Therefore, the slurry can continuously be fed into the twin roll type continuous strip caster by using the discharge nozzle provided with the means for heating the nozzle itself without causing troubles such as nozzle clogging due to the adhesion of solidification shell and the like and degrading the quality due to the overheating of the semi-solidified metal slurry passing through the nozzle, whereby the thin cast sheet can be produced by the continuous casting without troubles.

Furthermore, the production of the above semi-solidified metal slurry and the continuous casting thereof will concretely be described below.

As the agitation system in the production of the semi-solidified metal slurry, the electromagnetic agitating system is favorable (second invention) from viewpoints that it is applicable to high melting point metal, the semi-solidified metal slurry can be produced up to a solid fraction of 0.4, the maintenance is relatively simple and the like, or the agitator rotating system in which the agitator is mechanically rotated is favorable (third invention) from the same viewpoints as mentioned above. These systems facilitate the continuous production of the semi-solidified metal slurry.

However, it is impossible to continuously feed the semi-solidified metal slurry produced by these systems into the twin roll type continuous strip caster through the usual nozzle without clogging the nozzle.

The inventors have made various experiments and studies and found that it is effective and essential to positively and steady heat the nozzle as the discharge nozzle in order to solve the troubles such as nozzle clogging and the like.

That is, the heating is carried out by high frequency induction heating having a frequency of 40 kHz–200 kHz by means of a high frequency induction heating coil disposed around the outer periphery of the discharge nozzle (fourth invention), and further the nozzle is made from alumina graphite having a specific resistance of 500 μΩ·cm–12000 μΩ·cm (fifth invention), whereby the nozzle itself can be heated to a temperature of 1500° C. and also the semi-solidified metal slurry made from a high melting point metal can continuously be fed into the twin roll type continuous strip caster without troubles such as nozzle clogging and the like while holding heat by thermal conduction through nozzle wall.

In the heating of the discharge nozzle by the high frequency induction heating coil, a proper value of the frequency is selected within a range of 40 kHz–200 kHz. By adopting such a frequency is generated a surface skin effect, whereby a greater part of induction current can be concentrated in the nozzle body.

In practice, when the frequency is selected so as to apply not less than 80% of the induction current to the nozzle body, inconveniences such as the decrease of solid fraction produced by reheating of the semi-solidified metal, accumulation of fine primary solid particles and the like are practically solved without raising the temperature of the semi-solidified metal passing through the nozzle by the induction heating, whereby the degradation of the quality of the discharged semi-solidified metal can be prevented.

When the discharge nozzle of a ceramic refractory material having a high conductivity is heated by the high frequency induction heating, a relation between a depth flowing 80% of the induction current or a penetration depth (t) flowing 80% of induction current and a frequency applied (f) are represented by the following equation (1):

$$f=K\times R/t^2 \quad (1)$$

where f: frequency (kHz)

K: proportional constant (kHz/Ω)

R: specific resistance of nozzle (Ω·mm)

t: penetration depth (mm).

When the frequency is valuated by substituting practically properties of the discharge nozzle for the equation (1), a graph shown in FIG. 1 is obtained, from which the frequency is obtained within a range of 40 kHz–200 kHz because the wall thickness of the usual discharge nozzle is 15–40 mm.

Moreover, FIG. 1 is a graph showing a relation between the penetration depth flowing 80% of induction current and the frequency in the high frequency induction heating of the discharge nozzle.

Therefore, the frequency applied in the high frequency induction heating is 40 kHz–200 kHz.

As a material of the nozzle in the high frequency induction heating, alumina graphite as a high electrically conductive refractory substance is suitable because it possesses resistance to fusion loss and thermal shock resistance. In the alumina graphite, the electrical conductivity can be increased by increasing the amount of graphite. Considering the resistance to fusion loss, thermal shock resistance, oxidation resistance, hot deflective strength and the like, the graphite amount is suitable within a range of 10%–30%, which corresponds to a specific resistance of 500 μΩ·cm–12000 μΩ·cm (fifth invention).

Furthermore, the heating of the discharge nozzle may be conducted by the electric resistance heater disposed around the outer periphery of the nozzle (sixth invention), in which heat of the semi-solidified metal slurry is held by thermal conduction of the nozzle wall to obtain the same effect as in the high frequency induction heating.

Next, even if the solid phase is slight as a solid fraction of the semi-solidified metal slurry used in the continuous casting through the twin roll type continuous strip caster, the effect on the formation of fine structure and the dispersion of fine precipitates can fairly be expected. However, when the solid fraction is less than 0.01, coarse columnar crystal structure may partially be produced, so that the lower limit is 0.01. On the other hand, when the solid fraction exceeds 0.40, the viscosity of the slurry violently rises and the handling is difficult, so that the upper limit is 0.40 considering the operability (seventh invention).

As regards the thickness of the thin cast sheet, when the thickness exceeds 10 mm, the solidification rate is slow, so that the formation of fine structure and the dispersion of fine precipitates may not sufficient and hence there are caused the following problems on, for example, each of the metal materials.

In the austenitic stainless steel and the boron-containing austenitic stainless steel, granular crystal produced in the solidification is coarsened to form a liquid film at the crystal grain boundary, which is apt to cause the surface cracking and the ridging of the product.

In the ferritic stainless steel, granular crystal produced in the solidification is apt to be coarsened into columnar crystal, and a risk of generating the ridging in the product becomes large.

In the martensitic stainless steel, coarse carbide is apt to be produced in the central portion of the thin cast sheet and degrades the properties.

In the silicon steel for electromagnetic steel sheets, the formation of fine structure and the dispersion of fine MnS, MnSe and the like are apt to be insufficient. That is, the occurrence of the columnar crystal brings about the occurrence of the ridging in the product and the increase of scattering of crystal orientation texture, and also the effect of decreasing the temperature of solution treatment before the hot rolling in the grain oriented silicon steel sheet and the effect of improving the workability of high Si steel can not be expected.

In the phosphor bronze alloy and the high Sn copper alloy, the effect of preventing the occurrence of so-called tin sweat is less and Sn, P rich segregation is apt to be generated in the central portion of the thin cast sheet in the thickness direction to form δ-phase resulting in the work cracking.

Therefore, the thickness of the thin cast sheet is desirable to be not more than 10 mm (eighth invention).

Next, the function and effect in the production of thin cast sheets from each of the metal materials through the continuous casting will be described in order.

① Production for thin cast sheets of austenitic stainless steel (ninth invention)

The cracking in the hot work of the austenitic stainless steel results from the fact that the segregation of P and S as an impurity in steel is fairly large as compared with the case of the ferritic stainless steel. That is, the P, S rich layer is apt to be formed on a front surface of the solidification shell formed in the solidification step of the austenitic stainless steel and this rich layer finally produces the rich segregation at the crystal grain boundary while raising the concentration of P, S with the advance of the solidification.

The rich segregation portion is low in the solidification point and partly fuses when being reheated to a hot working temperature, which is a starting point of breakage in the hot working.

Since the hot cracking inherent to the austenitic stainless steel results from so-called liquid film brittleness, it is caused even by deformations at bulging, bend portion and unbend portion of the thin cast sheet in the continuous casting in addition to the hot working.

Assuming from the above causes of cracking, it is considered that in the continuous casting of the austenitic stainless steel, the segregation can be mitigated to control the occurrence of cracking by rapidly quenching molten steel. In fact, the improvement to a certain extent is attained by the rapid quenching, but the surface cracking can not be avoided only by simply increasing the solidification rate of molten steel.

This is due to the fact that the solidification structure of the thin cast sheet is a coarse columnar crystal structure extending from the surface layer of the thin cast sheet toward the center thereof in the thickness direction and the liquid film produced in the crystal grain boundary is largely mitigated as a whole but a large liquid film is locally formed.

According to the invention, the semi-solidified metal slurry obtained by agitating at a temperature region of not higher than the liquidus line but not lower than the solidus line is cast by using the twin roll type continuous strip caster, so that the formation of coarse columnar crystal structure is controlled and a mixed structure consisting of fine granular solid particles (hereinafter referred to as primary solid particles) and granular crystal can be obtained, whereby the surface cracking inherent to the austenitic stainless steel is advantageously avoided.

And also, the continuous casting of the semi-solidified metal slurry of the austenitic stainless steel with the twin roll type continuous strip caster has the following advantages as compared with the case of using molten metal in addition to the avoidance of surface cracking in the thin cast sheet.

(1) The productivity can be increased because the solidification rate is large.

(2) Since a part of latent heat in the solidification is released, the thermal loading to the cooling roll is mitigated and it is possible to prolong the service life of the roll.

(3) Since the slurry has an adequate viscosity, the surface properties can be improved.

In addition to the above (1)–(3), since the primary solid particles are suspended in a liquid phase of the semi-solidified metal slurry, the cast structure is a mixed structure consisting of the primary solid particles existing as a solid phase in the slurry and fine granular crystal produced in the casting and hence there is formed no coarse columnar crystal structure as formed in the continuous casting of molten metal.

Moreover, these advantages are obtained even in the case of the following metal materials.

② Production for thin cast sheets of boron-containing austenitic stainless steel (tenth invention)

There have been made various studies and examinations on the hot workability of the boron-containing austenitic stainless steel and it has been found that the degradation of the hot workability results from a fact that borides being mainly compounds of B with Fe and Cr produced in austenite crystal grain boundary at the solidification stage are starting points for breaking the austenite crystal grain boundary in the hot working and further the boride produced in the crystal grain boundary become much and coarse as the crystal grain size of austenite becomes large to degrade the hot workability.

Therefore, a method wherein the austenite crystal grains produced at the solidification stage is fined to finely disperse boride precipitates into the grain boundary is effective to improve the hot workability.

In the usual casting method of steel ingot and the continuous casting method for the thin cast sheets having a thickness of about 150 mm, the solidification rate is slow, so that it is difficult to fine the austenite crystal grains at the solidification stage.

Further, there is considered a method wherein the thin cast sheet is directly produced from molten metal aiming at the rapid quenching to omit the hot rolling. In this method, the solidification rate becomes faster, but the coarse columnar crystal is formed from the surface of the thin cast sheet toward the center thereof because the supplied molten metal has a superheat (temperature difference between molten metal temperature and liquids line), so that the formation of fine austenite crystal grain can not be attained. Moreover, since the coarse boride is formed in the grain boundary of columnar austenite crystal grains, the cracking is frequently generated in the bend-unbend portions during the casting of the thin cast sheet or in the coiling portion, so that the sheet is difficult as a raw rolling material for the production of steel sheets.

Under the above circumstances, according to the invention, the semi-solidified metal slurry of austenitic stainless steel having the B content of 0.5–4.0 wt % obtained by agitating at a solid-liquid coexisting region is rapidly quenched and cast in the twin roll type continuous strip caster, so that the formation of columnar crystal can completely be prevented in the resulting thin cast sheet and the structure is a mixed structure consisting of the fine and columnar primary solid particles suspended in the semi-solidified metal slurry and the fine granular crystal produced by rapidly quenching the liquid phase of the semi-solidified metal slurry with the surface of the roll and hence the boride precipitated in the austenite crystal grain boundary can finely be dispersed.

As a result, the hot workability is excellent and the cracking can be prevented at the casting step for the thin cast sheet and the raw rolling material for cold rolled steel sheets omitting the hot rolling can be obtained.

Next, the invention will be described with the following experiment.

Each of molten metal (superheat ΔT: 60° C.) and semi-solidified metal slurry (solid fraction: 0.2) of SUS304 austenitic stainless steel containing B: 2.0 wt % is supplied to a twin roll type continuous strip caster to form a thin cast sheet having a thickness: 8 mm, and then a metal structure at section of the resulting thin cast sheet is examined.

Microphotographs of these metal structures are shown in FIG. 2 and FIG. 3, respectively.

FIG. 2 is a microphotograph of the metal structure of the thin cast sheet made from molten metal of SUS304 austenitic stainless steel containing B: 2.0 wt %, and FIG. 3 is a microphotograph of the metal structure of the thin cast sheet made from semi-solidified metal slurry of SUS304 austenitic stainless steel containing B: 2.0 wt %.

As seen from these figures, the metal structure at section of the thin cast sheet made from molten metal (FIG. 2) is comprised of coarse columnar crystal produced from the surface of the thin cast sheet toward the center thereof, while the metal structure at section of the thin cast sheet made from the semi-solidified metal slurry (FIG. 3) is comprised of fine austenite crystal grains.

Further, thin cast sheets having a thickness: 8 mm are cast in the twin roll type continuous strip caster by varying superheat of molten metal and solid fraction of semi-solidified metal slurry in SUS304 austenitic stainless steel containing B: 2.1 wt %, respectively, and then the area ratio of columnar crystal occupied in the section of the thin cast sheet is measured with respect to the resulting thin cast sheets. The measured results are shown in FIG. 4 together.

FIG. 4 is a graph showing a relation of the superheat of molten metal and the solid fraction of semi-solidified metal slurry to the occupying area ratio of columnar crystal at section of the thin cast sheet in SUS304 austenitic stainless steel containing B: 2.1%.

As seen from this figure, when the superheat ΔT of the supplied molten metal is 0° C. (solid fraction: 0), the columnar crystal is somewhat formed, while when the solid fraction of the semi-solidified metal slurry is not less than 0.1, the columnar crystal is not formed, which shows that the formation of columnar crystal can completely be controlled by the method according to the invention.

As to the chemical composition, B is added to austenitic stainless steels having excellent corrosion resistance and heat resistance. The B content is required to be not less than 0.5 wt % in order to effectively develop neutron shielding effect, while when it exceeds 4.0 wt %, it is difficult to completely control the occurrence of the cracking in the casting even by using the method according to the invention. Therefore, the B content is within a range of 0.5–4.0 wt %.

Moreover, the invention is preferably applied to B-added SUS304, SUS304L, SUS309S, SUS310S and the like but is advantageously applicable to steels obtained by adding b to the other austenitic stainless steels.

③ Production for thin cast sheets of ferritic stainless steel (eleventh invention)

The ridging generated in the ferritic stainless steel sheet results from a fact that the solidification structure of the thin cast sheet as a raw rolling material forms a coarse columnar crystal.

According to the invention, the semi-solidified metal slurry obtained by agitating at a temperature region of not higher than liquidus line but not lower than solidus line is rendered into a thin cast sheet by rapidly quenching in the twin roll type continuous strip caster to prevent the formation of columnar crystal, so that the resulting thin cast sheet may have no formation of columnar crystal and the structure thereof is a mixed structure consisting of the fine and columnar primary solid particles suspended in the semi-solidified metal slurry and the fine granular crystal produced by rapidly quenching the liquid phase of the semi-solidified metal slurry with the surface of the roll. Therefore, there is caused no ridging in the forming work of the steel sheet made from the thin cast sheet.

Next, the invention will be described with the following experiment.

Thin cast sheets having a thickness: 6 mm are cast in the twin roll type continuous strip caster by varying superheat of molten metal and solid fraction of semi-solidified metal slurry in SUS430 ferritic stainless steel, and then the area ratio of columnar crystal occupied in the section of the thin cast sheet is measured with respect to the resulting thin cast sheets. The measured results are shown in FIG. 5 together.

FIG. 5 is a graph showing a relation of the superheat of molten metal and the solid fraction of semi-solidified metal slurry to the occupying area ratio of columnar crystal at section of the thin cast sheet in SUS430 ferritic stainless steel.

As seen from this figure, when the superheat ΔT of the supplied molten metal is 0° C. (solid fraction: 0), the columnar crystal is somewhat formed, while when the solid fraction of the semi-solidified metal slurry is not less than 0.1, the columnar crystal is not formed, which shows that the formation of columnar crystal can completely be controlled by the method according to the invention.

④ Production for thin cast sheets of martensitic stainless steel (twelfth invention)

The martensitic stainless steel, particularly high-carbon Cr martensitic steel is a hyper-eutectoid steel and primary carbide is precipitated therein. A greater amount of coarse carbide is precipitated in a central portion of the slab creating macrosegregation to degrade the properties. According to the invention, the semi-solidified metal slurry obtained by agitating at a temperature region of not higher than liquids line but not lower than solids line is rendered into a thin cast sheet by rapidly quenching in the twin roll type continuous strip caster, so that the thin cast sheet is a mixed structure consisting of the fine and columnar primary solid particles suspended in the semi-solidified metal slurry and the fine granular crystal produced by rapidly quenching the liquid phase of the semi-solidified metal slurry with the surface of the roll, and the macrosegregation becomes less. Therefore, there are obtained thin cast sheets having less coarse carbide and less surface cracking.

⑤ Production for thin cast sheets of silicon steel (thirteenth invention)

When the silicon steel for electromagnetic steel sheets is rendered into a thin cast sheet by casting the semi-solidified metal slurry obtained under agitation at the solid-liquids coexisting region with the use of the twin roll type continuous strip caster, the solidification structure is a uniform granular structure as a whole of the thin cast sheet, and the solidification time is very short as compared with the casting of molten metal, so that the crystal grain is small and the component segregation is largely mitigated and the precipitates of MnS, MnSe and the like acting as the inhibitor are dispersed finely and uniformly.

Therefore, when grain oriented electromagnetic steel sheet is produced by using such a thin cast sheet, the solution treatment finely precipitating MnS and MnSe before the hot rolling for obtaining good electromagnetic properties can be carried out at a lower temperature and hence various troubles generated when the temperature of the solution treatment is high can largely be mitigated and the operation is considerably improved.

Since the solidification structure of the thin cast sheet is a granular structure having a uniform and small grain size, the electromagnetic steel sheet made from this thin cast sheet removes the occurrence of the ridging resulted from the columnar crystal produced in the casting of molten metal and has less scattering of crystal orientation texture and improves the electromagnetic properties.

Moreover, the invention is advantageously applied to the production of grain oriented electromagnetic steel sheets, but is advantageously applicable to the production of non-oriented electromagnetic steel sheets because the effect of controlling the ridging and the effect of improving the electromagnetic properties are developed.

In general, when the Si content exceeds 5 wt %, the brittleness becomes conspicuous and the hot rolling and cold rolling are impossible. However, even when the thin cast sheet obtained according to the invention contains a great amount of Si as mentioned above, the surface cracking is less and the cold rolling is possible.

In the invention, therefore, the Si content is within a range of 3.0–6.5 wt %, which is a region hardly conducting the work in the conventional technique, and the Mn content required for the precipitation of MnS and the like is not more than 2.5 wt %.

⑥ Production for thin cast sheets of phosphor bronze alloy or high Sn copper alloy (fourteenth invention, fifteenth invention)

In the phosphor bronze alloy or high Sn copper alloy, when the semi-solidified metal slurry is formed by strong agitation at a solid phase and liquid phase coexisting temperature region, the slurry is at a state of suspending the primary granular solid particles in the liquid phase. When such a semi-solidified metal slurry is cast in the twin roll type continuous strip caster, the cast structure of the thin cast sheet is a mixed structure consisting of primary solid particles existing as the solid phase in the slurry and fine granular crystal produced in the casting, so that there is formed no dendritic columnar crystal structure as observed in the continuous casting of molten metal. According to the invention, therefore, there can be obtained thin cast sheets having excellent surface properties without tin sweat and δ-phase.

BEST MODE FOR CARRYING OUT THE INVENTION

EXAMPLE 1

At first, an apparatus used in this example will be described with reference to FIG. 6.

Figure 1:
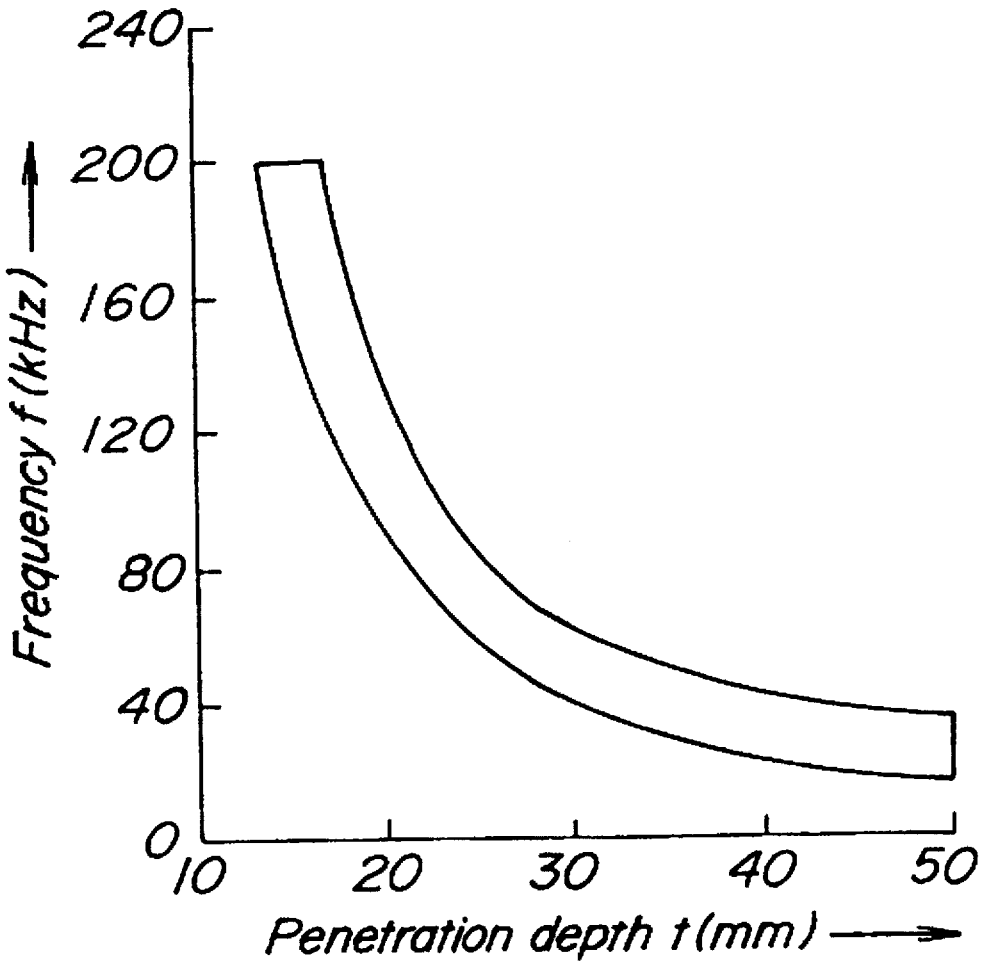
FIG. 1 is a graph showing a relation between penetration depth flowing 80% of induction current and frequency in a high frequency induction heating of a discharge nozzle.
Figure 2:
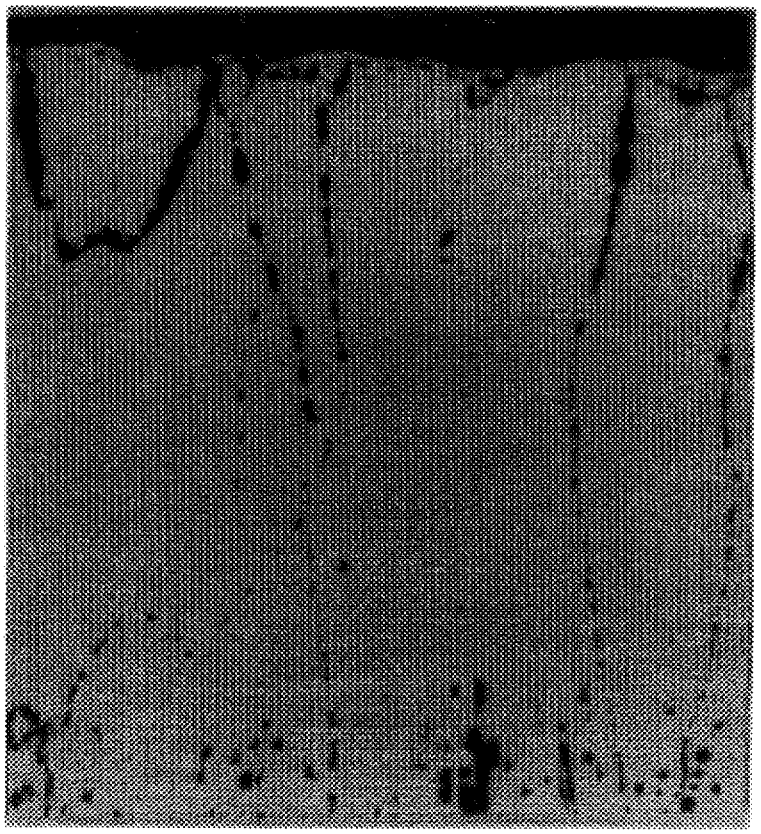
FIG. 2 is a microphotograph of a metal structure of a thin case sheet of SUS304 austenitic stainless steel containing B: 2.0% made from molten metal.
Figure 3:
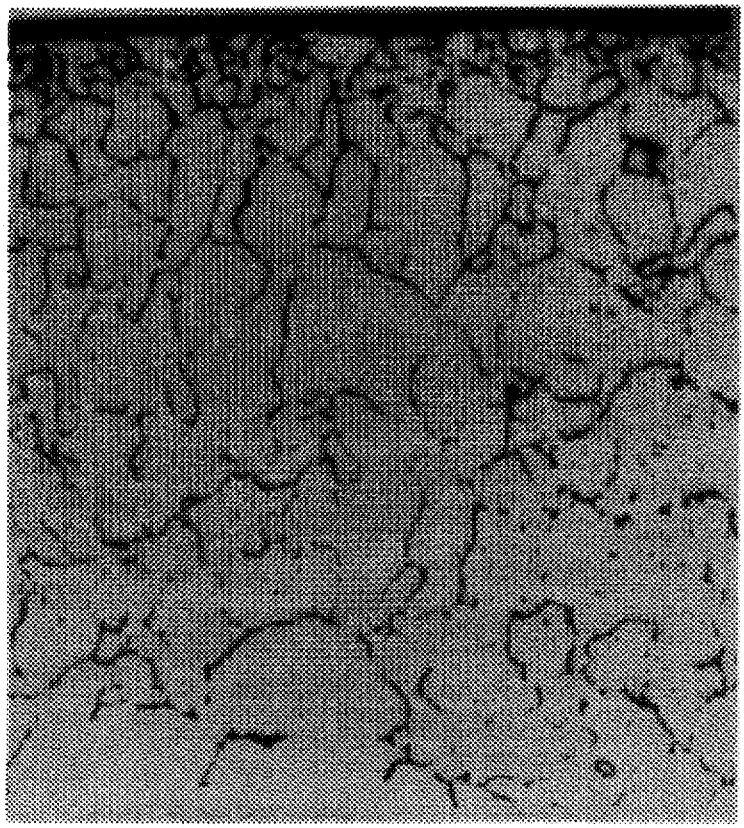
FIG. 3 is a microphotograph of a metal structure of a thin case sheet of SUS304 austenitic stainless steel containing B: 2.0% made from semi-solidified metal slurry.
Figure 4:
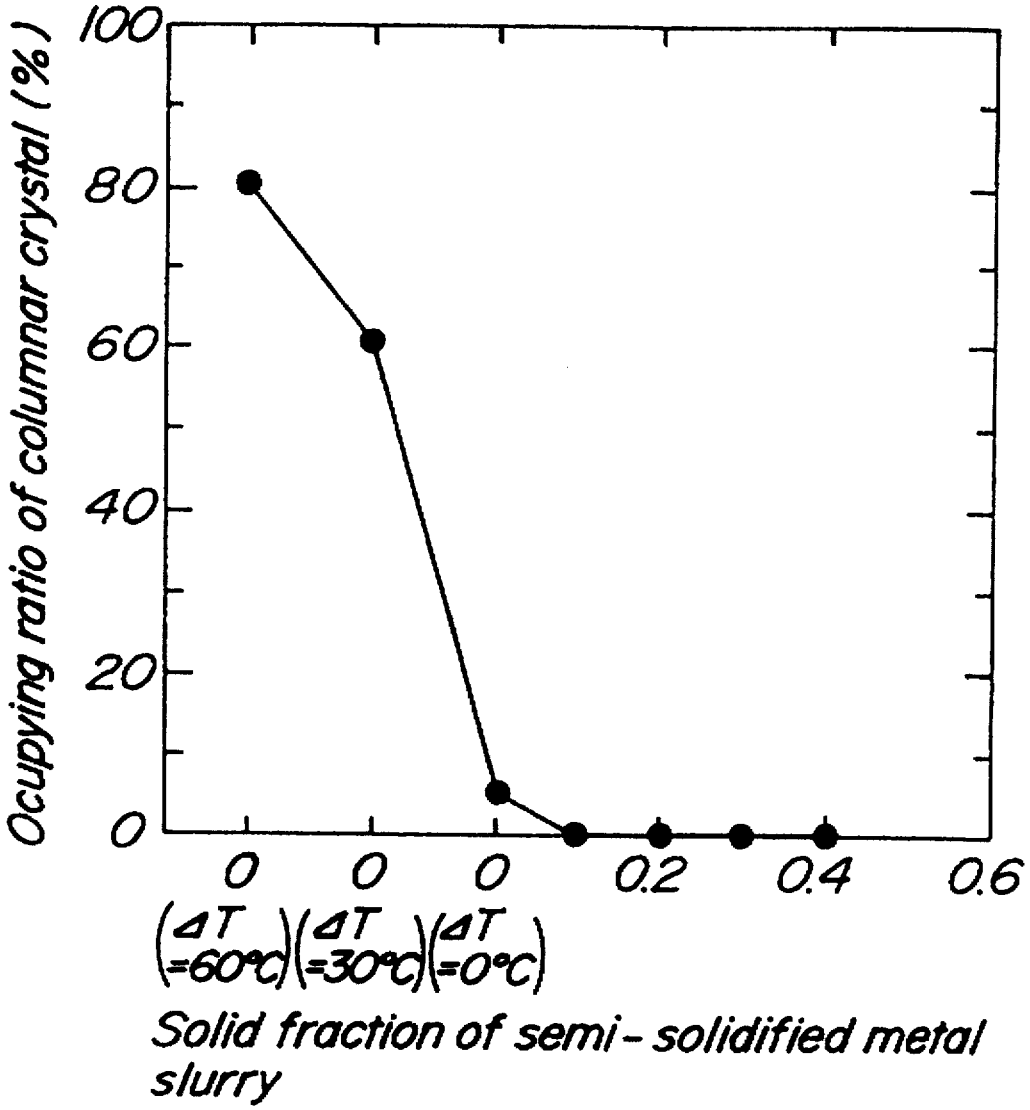
FIG. 4 is a graph showing a relation of superheat of molten metal and solid fraction of semi-solidified metal slurry to area ratio of columnar crystal occupied at section of thin cast sheet in SUS304 austenitic stainless steel containing B: 2.1%.
Figure 5:
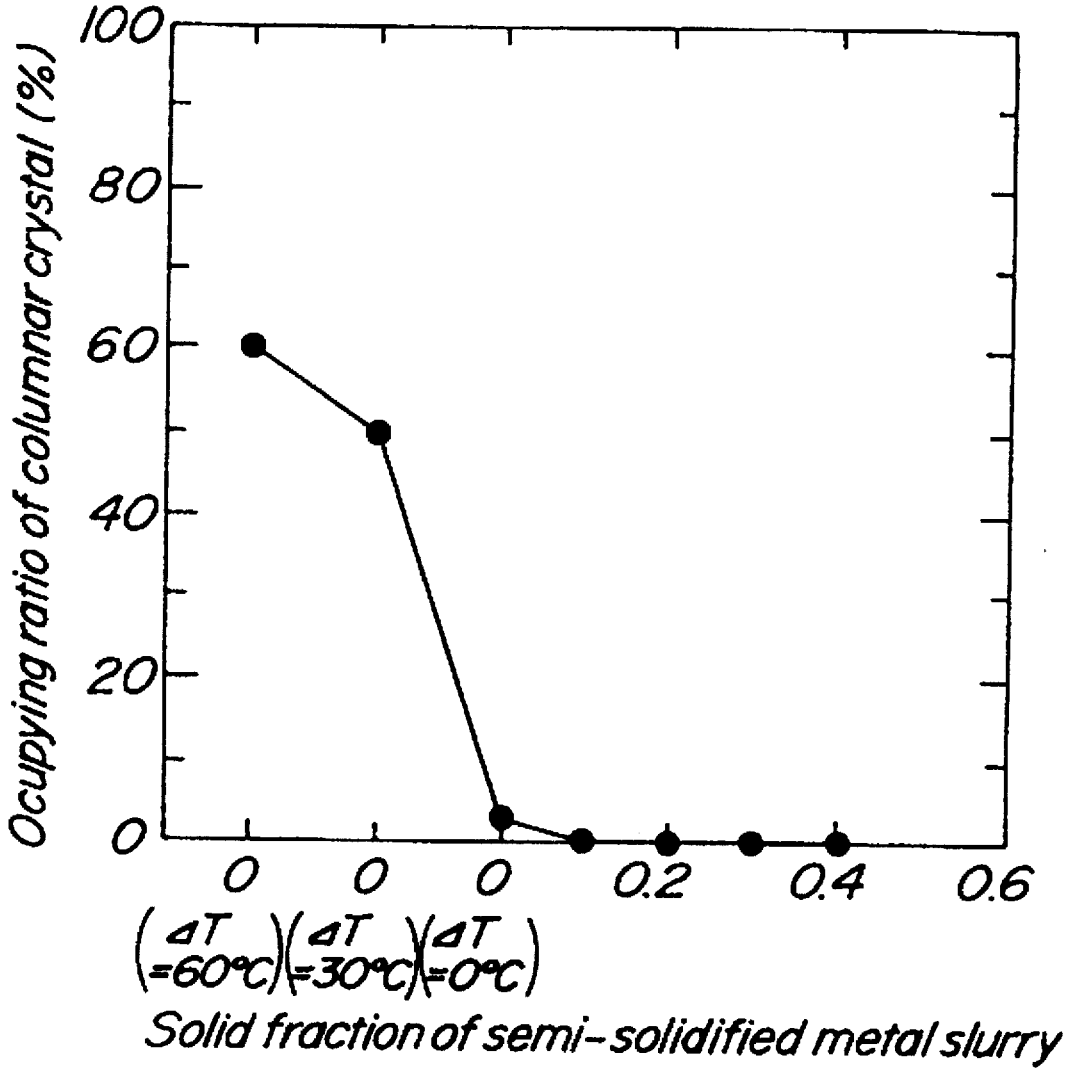
FIG. 5 is a graph showing a relation of superheat of molten metal and solid fraction of semi-solidified metal slurry to area ratio of columnar crystal occupied at section of thin cast sheet in SUS430 ferritic stainless steel.
Figure 6:
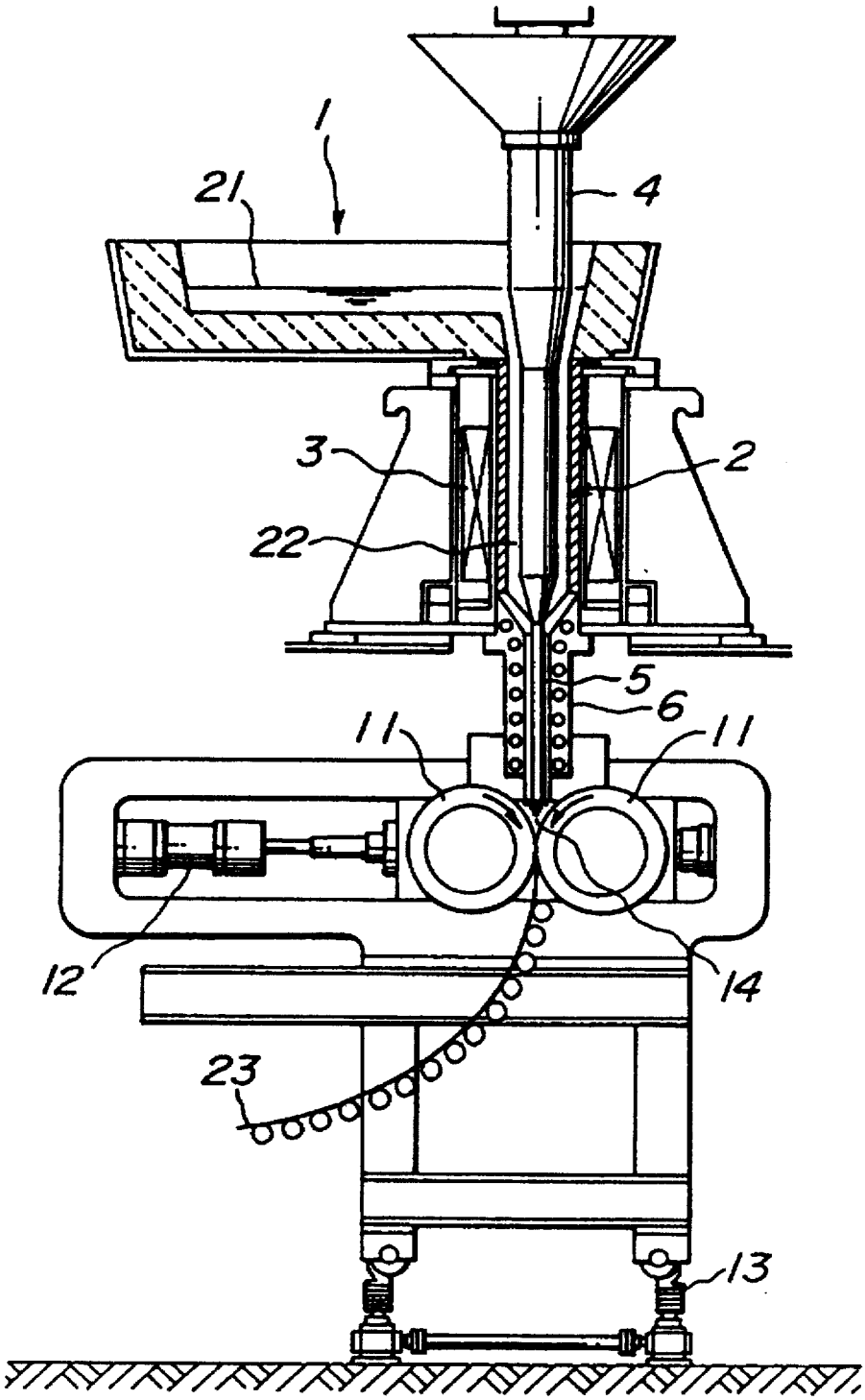
FIG. 6 is a diagrammatic view illustrating a series of an apparatus for the production of semi-solidified metal slurry through electromagnetic agitation, a discharge nozzle and a twin roll type continuous strip caster used in the examples.

FIG. 6 is a diagrammatic view illustrating a series of an apparatus for the production of semi-solidified metal slurry through electromagnetic agitation, a discharge nozzle and a twin roll type continuous strip caster used in the example.

In this figure, numeral 1 is a tundish, numeral 2 a cooling agitation tank provided with a water-cooled jacket, numeral 3 an electromagnetic agitation coil disposed around the outer periphery of the cooling agitation tank, numeral 4 a core stopper, numeral 5 a discharge nozzle, numeral 6 a high frequency heating coil disposed around the outer periphery of the discharge nozzle 5, numeral 11 two rolls of a twin roll type continuous strip caster, numeral 12 a hydraulic cylinder adjusting a distance between the two rolls, numeral 13 a lifting device adjusting positions of the two rolls in up and down directions, numeral 14 a pouring basin portion just above roll kiss portion, numeral 21 molten metal, numeral 22 a semi-solidified metal slurry, and numeral 23 a thin cast sheet.

Moreover, the discharge nozzle 5 is made from alumina graphite, and the two rolls 11 are water-cooled copper rolls and have dimensions of roll diameter: 400 mm, roll width: 205 mm, roll distance: 0–30 mm and roll revolution number: 5–50 rpm.

The production of the semi-solidified metal slurry and the production of the thin cast sheet through the continuous casting are conducted by using this apparatus as follows.

A molten metal is continuously fed from a vessel (not shown) to the tundish 1. The molten metal 21 fed into the tundish 1 flows downward in the cooling agitation tank 2, at where it is agitated under an action of electromagnetic force of the electromagnetic agitation coil 3 (power: 700 KVA, magnetic flux density: 1000 gauss) while cooling to produce the semi-solidified metal slurry 22. The semi-solidified metal slurry 22 is fed into the pouring basin portion 14 of the twin roll type continuous strip caster through the discharge nozzle 5 induction-heated by means of the high frequency heating coil 6 (frequency: 100 kHz, power: 20 kW) while controlling the flow rate by adjusting up and down movements of the core stopper 4, at where it is cooled and solidified by the two rolls 11 to form the thin cast sheet 23.

As to austenitic stainless steels of SUS310S (Cr: 25 wt %, Ni: 21 wt %) and SUS316L (Cr: 17 wt %, Ni: 14 wt %, Mo: 2.5 wt %), semi-solidified metal slurrys are produced in the above apparatus by varying the solid fraction within a range of not more than 0.45. Then, thin cast sheets having a thickness: 3–12 mm are produced by the continuous casting from the above semi-solidified metal slurrys and molten metal used for the comparison, respectively, and then the castability (operability) and the structure and degree of surface cracking of the resulting cast sheet are evaluated.

The evaluated results are shown in Table 1 together with the production conditions.

TABLE 1

| Sample No. | Kind of steel | Solid Fraction | Thickness (mm) | Cast structure | Degree of surface cracking | Castability | Remarks |
|---|---|---|---|---|---|---|---|
| 1 | SUS310S | 0 | 3.0 | coarse columnar crystal | frequently occur | good | Comparative Example |
| 2 | SUS310S | 0.05 | 3.0 | primary solid particles + fine granular crystal | none | good | Acceptable Example |
| 3 | SUS310S | 0.20 | 3.0 | primary solid particles + fine granular crystal | none | good | Acceptable Example |
| 4 | SUS310S | 0.40 | 6.0 | primary solid particles + fine granular crystal | none | good | Acceptable Example |
| 5 | SUS310S | 0.45 | 6.0 | — | — | no castable | Comparative Example |
| 6 | SUS316L | 0.20 | 6.0 | primary solid particles + fine granular crystal | none | good | Acceptable Example |
| 7 | SUS316L | 0.20 | 10.0 | primary solid particles + fine granular crystal | none | good | Acceptable Example |
| 8 | SUS316L | 0.20 | 12.0 | primary solid particles + coarse granular crystal | somewhat occur | good | Comparative Example |

In Sample Nos. 2, 3, 4, 6 and 7 (acceptable examples) of Table 1, the cast structure is a mixed structure of primary solid particles and fine granular crystal, and the surface cracking of the thin cast sheet is not observed and the castability is good. On the contrary, in Sample No. 1 having a solid fraction of 0% (complete molten metal), the cast structure is comprised of coarse columnar crystal and the surface cracking frequently occurs. Furthermore, in Sample No. 5 having a solid fraction of 0.45, the fluidity of the semi-solidified metal slurry is poor and the casting can not be conducted, while in Sample No. 8 (thickness exceeds 10 mm), the cast structure is a mixed structure consisting of primary solid particles and coarse granular crystal, so that the surface cracking is somewhat observed.

Moreover, in the acceptable examples according to the invention, when final products are obtained by subjecting to cold rolling and annealing treatment according to the usual manner, the quality is confirmed to be substantially the same level as in the conventional product obtained through steel ingot—blooming—hot rolling.

EXAMPLE 2

A semi-solidified metal slurry is produced by varying the solid fraction within a range of not more than 0.45 in SUS304 austenitic stainless steel containing B: 0.5–5.0 wt % with the use of the apparatus used in Example 1. Then, thin cast sheets having a thickness: 5–12 mm are produced by the continuous casting from the above semi-solidified metal slurrys and molten metal used for the comparison, respectively, and then the castability (operability) and the columnar crystal occupying area ratio at section and the presence or absence of surface cracking in the resulting cast sheet are evaluated.

The evaluated results are shown in Table 2 together with the production conditions.

TABLE 2

| Sample No. | B content (wt) | Thickness of thin cast sheet (mm) | Solid fraction | Cast-ability | Columnar crystal occupying area ratio (%) | Surface cracking of thin cast sheet | Remarks |
|---|---|---|---|---|---|---|---|
| 1 | 0.5 | 5 | 0.05 | good | 0 | A | Acceptable Example |
| 2 | 2.0 | 10 | 0.10 | good | 0 | A | Acceptable Example |
| 3 | 3.0 | 8 | 0.20 | good | 0 | A | Acceptable Example |
| 4 | 4.0 | 8 | 0.30 | good | 0 | A | Acceptable Example |
| 5 | 2.0 | 8 | 0.40 | good | 0 | A | Acceptable Example |

TABLE 2-continued

| Sample No. | B content (wt) | Thickness of thin cast sheet (mm) | Solid fraction | Cast-ability | Columnar crystal occupying area ratio (%) | Surface cracking of thin cast sheet | Remarks |
|---|---|---|---|---|---|---|---|
| 6 | 2.0 | 8 | 0 (ΔT = 60° C.) | good | 80 | C | Comparative Example |
| 7 | 2.0 | 8 | 0.45 | no castable | — | — | Comparative Example |
| 8 | 2.0 | 12 | 0.20 | good | 50 | B | Comparative Example |
| 9 | 5.0 | 8 | 0.30 | good | 0 | C | Comparative Example |

Moreover, the judgment of surface cracking of the thin cast sheet in Table 2 is conducted by three stage evaluation according to the following standard.

A: no cracking

B: small cracking

C: many cracking

As seen from Table 2, the castability is poor, or the formation of columnar crystal or the occurrence of surface cracking in the thin cast sheet is observed in the comparative examples, while in the method according to the invention, the castability is good and the formation of columnar crystal or the occurrence of surface cracking is not observed in the resulting thin cast sheets. Moreover, when the B content is 5.0 wt % (Sample No. 9), the surface cracking occurs in the thin cast sheet, while when it is 4.0 wt % (Sample No. 4), no cracking occurs, so that the upper limit of the content is preferably 4.0 wt %.

Furthermore, when the thin cast sheets obtained by the method according to the invention (Sample Nos. 1–5) are annealed (1150° C.·1 hour)—pickled and cold-rolled at a draft: 40–60% to produce final products, there can be obtained all cold rolled sheets having excellent surface properties without cracking.

EXAMPLE 3

A semi-solidified metal slurry is produced by varying the solid fraction within a range of not more than 0.45 in SUS430 and SUS430LX ferritic stainless steels with the use of the apparatus used in Example 1. Then, thin cast sheets having a thickness: 4–15 mm are produced by the continuous casting from the above semi-solidified metal slurrys and molten metal used for the comparison, respectively, and then the columnar crystal occupying area ratio at section of the resulting cast sheet is evaluated.

Furthermore, these thin cast sheets are subjected to an annealing at a temperature: 950° C. and cold-rolled at a draft: 75–80%. Thereafter, these cold rolled sheets are annealed at a temperature: 750°–850° C. and then subjected to pickling.

The thus obtained steel sheets are subjected to deep drawing into a cylinder of 100 mm in diameter and the degree of ridging occurrence is measured by surface observation.

The measured results are shown in Table 3 together with the production conditions.

TABLE 3

| Sample No. | Kind of steel | Thickness of thin cast sheet (mm) | Solid fraction | Columnar crystal occupying area ratio (%) | Annealing temperature before cold rolling (°C.) | Cold rolling draft (%) | Annealing temperature after cold rolling (°C.) | Judgment of ridging | Remarks |
|---|---|---|---|---|---|---|---|---|---|
| 1 | SUS430 | 4 | 0.05 | 0 | 950 | 75 | 750 | A | Acceptable Example |
| 2 | SUS430 | 6 | 0.10 | 0 | 950 | 75 | 750 | A | Acceptable Example |
| 3 | SUS430 | 6 | 0.40 | 0 | 950 | 75 | 750 | A | Acceptable Example |
| 4 | SUS430 | 10 | 0.20 | 0 | 950 | 85 | 750 | A | Acceptable Example |
| 5 | SUS430LX | 5 | 0.30 | 0 | 950 | 75 | 800 | A | Acceptable Example |
| 6 | SUS430LX | 5 | 0.05 | 0 | 950 | 75 | 800 | A | Acceptable Example |
| 7 | SUS430 | 6 | 0.50 | — | no castable | | — | — | Comparative Example |
| 8 | SUS430 | 12 | 0.10 | 20 | 950 | 85 | 750 | B | Comparative Example |
| 9 | SUS430 | 15 | 0.20 | 35 | 950 | 85 | 750 | C | Comparative Example |
| 10 | SUS430 | 6 | 0 (ΔT = 30° C.) | 45 | 950 | 75 | 750 | C | Comparative Example |

TABLE 3-continued

| Sample No. | Kind of steel | Thickness of thin cast sheet (mm) | Solid fraction | Columnar crystal occupying area ratio (%) | Annealing temperature before cold rolling (°C.) | Cold rolling draft (%) | Annealing temperature after cold rolling (°C.) | Judgment of ridging | Remarks |
|---|---|---|---|---|---|---|---|---|---|
| 11 | SUS430 | 6 | 0 (ΔT = 60° C.) | 60 | 950 | 75 | 750 | C | Comparative Example |
| 12 | SUS430LX | 6 | 0 (ΔT = 60° C.) | 55 | 950 | 75 | 800 | C | Comparative Example |

Moreover, the judgment of the ridging in Table 3 is conducted by three stage evaluation according to the following standard.

A: no ridging

B: small ridging

C: many ridging

As seen from Table 3, the formation of columnar crystal and the occurrence of the ridging are observed in the comparative examples, while in the thin cast sheets obtained by the method according to the invention (acceptable examples), the columnar crystal occupying area ratio is 0% and there is observed no occurrence of the ridging on the surface of the deep drawn product after the working to the steel sheet.

EXAMPLE 4

A semi-solidified metal slurry is produced by varying the solid fraction within a range of not more than 0.45 in SUS440C martensitic stainless steel (C: 1.1 mass %, Cr: 17.0 wt %) with the use of the apparatus used in Example 1. Then, thin cast sheets having a thickness: 3–12 mm are produced by the continuous casting from the above semi-solidified metal slurrys and molten metal used for the comparison, respectively, and then the castability (operability) and the structure and degree of surface cracking in the resulting cast sheet are evaluated.

The evaluated results are shown in Table 4 together with the production conditions.

In Sample Nos. 2, 3, 4, 6 and 7 (acceptable examples) of Table 4, the cast structure is a mixed structure consisting of primary solid particles and fine granular crystal, and the surface cracking of the thin cast sheet is not observed and the castability is good. On the contrary, in Sample No. 1 having a solid fraction of 0% (complete molten metal), the cast structure is comprised of coarse columnar crystal and the surface cracking frequently occurs. Furthermore, in Sample No. 5 having a solid fraction of 0.45, the fluidity of the semi-solidified metal slurry is poor and the casting can not be conducted, while in Sample No. 8 (thickness exceeds 10 mm), the cast structure is a mixed structure consisting of primary solid particles and coarse granular crystal, so that the surface cracking is somewhat observed.

Moreover, in the acceptable examples according to the invention, when final products are obtained by subjecting to cold rolling and annealing treatment according to the usual manner, the quality is confirmed to be substantially the same level as in the conventional product obtained through steel ingot—blooming—hot rolling.

EXAMPLE 5

A semi-solidified metal slurry is produced by varying the solid fraction within a range of not more than 0.45 in silicon steel containing Si of 3.3 wt % or 6.5 wt % with the use of the apparatus used in Example 1. Then, thin cast sheets having a thickness: 3–12 mm are produced by the continuous casting from the above semi-solidified metal slurrys and molten metal used for the comparison, respectively, and then the castability (operability) and the structure and degree of surface cracking in the resulting cast sheet are evaluated.

TABLE 4

| Sample No. | Solid fraction | Thickness (mm) | Cast structure | Degree of surface cracking | Castability | Remarks |
|---|---|---|---|---|---|---|
| 1 | 0 (ΔT = 60° C.) | 3.0 | coarse columnar crystal | frequently occur | good | Comparative Example |
| 2 | 0.05 | 3.0 | primary solid particles + fine granular crystal | none | good | Acceptable Example |
| 3 | 0.20 | 3.0 | primary solid particles + granular crystal | none | good | Acceptable Example |
| 4 | 0.40 | 6.0 | primary solid particles + fine granular crystal | none | good | Acceptable Example |
| 5 | 0.45 | 6.0 | — | — | no castable | Comparative Example |
| 6 | 0.20 | 6.0 | primary solid particles + fine granular crystal | none | good | Acceptable Example |
| 7 | 0.20 | 10.0 | primary solid particles + fine granular crystal | none | good | Acceptable Example |
| 8 | 0.20 | 12.0 | primary solid particles + coarse granular crystal | somewhat occur | good | Comparative Example |

Moreover, the coarse carbide is not formed in all of the above cases according to the structure observation.

The evaluated results are shown in Table 5 together with the production conditions.

TABLE 5

| Sample No. | Si content (wt) | Solid fraction | Thickness (mm) | Cast structure | Degree of surface carcking | Castability | Remarks |
|---|---|---|---|---|---|---|---|
| 1 | 3.3 | 0 (ΔT = 60° C.) | 3.0 | coarse columnar crystal | frequently occur | good | Comparative Example |
| 2 | 3.3 | 0.05 | 3.0 | primary solid particles + fine granular crystal | none | good | Acceptable Example |
| 3 | 3.3 | 0.20 | 3.0 | primary solid particles + fine granular crystal | none | good | Acceptable Example |
| 4 | 3.3 | 0.40 | 6.0 | primary solid particles + fine granular crystal | none | good | Acceptable Example |
| 5 | 3.3 | 0.45 | 6.0 | — | — | no castable | Comparative Example |
| 6 | 3.3 | 0.20 | 6.0 | primary solid particles + fine granular crystal | none | good | Acceptable Example |
| 7 | 3.3 | 0.20 | 10.0 | primary solid particles + fine granular crystal | none | good | Acceptable Example |
| 8 | 3.3 | 0.20 | 12.0 | primary solid particles + coarse granular crystal | somewhat occur | good | Comparative Example |
| 9 | 6.5 | 0.20 | 3.0 | primary solid particles + fine granular crystal | none | good | Acceptable Example |
| 10 | 6.5 | 0 (ΔT = 60° C.) | 3.0 | coarse columnar crystal occur | frequently | good | Comparative Example |

In Sample Nos. 2, 3, 4, 6, 7 and 9 (acceptable examples) of Table 5, the cast structure is a mixed structure consisting of primary solid particles and fine granular crystal, and the surface cracking of the thin cast sheet is not observed and the castability is good. On the contrary, in Sample Nos. 1 and 10 having a solid fraction of 0% (complete molten metal), the cast structure is comprised of coarse columnar crystal and the surface cracking frequently occurs. Furthermore, in Sample No. 5 having a solid fraction of 0.45, the fluidity of the semi-solidified metal slurry is poor and the casting can not be conducted, while in Sample No. 8 (thickness exceeds 10 mm), the cast structure is a mixed structure consisting of primary solid particles and coarse granular crystal, so that the surface cracking is somewhat observed.

When these thin cast sheets are cold-rolled at a draft: 40%, all thin cast sheets exhibiting the surface cracking cause the cracking during the cold rolling, while all thin cast sheets exhibiting no surface cracking do not cause the cracking even in the cold rolling to produce normal cold rolled products.

EXAMPLE 6

A semi-solidified metal slurry is produced by varying the solid fraction within a range of not more than 0.45 in phosphor bronze alloy containing Sn: 3.5–9.0 wt % and P: 0.03–0.35 wt % or high Sn copper alloy containing Sn: 10–25 wt % with the use of the apparatus used in Example 1. Then, thin cast sheets having a thickness: 3–12 mm are produced by the continuous casting from the above semi-solidified metal slurrys and molten metal used for the comparison, respectively, and then the castability (operability), the solidification structure of the resulting thin cast sheet, the degree of tin sweat and the state of forming coarse δ-phase are evaluated.

The evaluated results are shown in Table 6 together with the production conditions.

TABLE 6

| Sample No. | Alloy to be tested | Solid fraction | Thickness (mm) | Solidification structure | Tin sweat | Formation of coarse δ-phase | Castability | Remarks |
|---|---|---|---|---|---|---|---|---|
| 1 | Cu-9%Sn-0.35%P | 0 | 3.0 | columnar crystal | occurred | great formation | good | Comparative Example |
| 2 | Cu-9%Sn-0.35%P | 0.05 | 3.0 | primary solid particles + fine granular crystal | not occurred | none | good | Acceptable Example |
| 3 | Cu-9%Sn-0.35%P | 0.40 | 6.0 | primary solid particles + fine granular crystal | not occurred | none | good | Acceptable Example |
| 4 | Cu-9%Sn-0.35%P | 0.45 | 3.0 | — | — | — | no castable | Comparative Example |
| 5 | Cu-4%Sn-0.03%P | 0.20 | 10.0 | primary solid particles + fine granular crystal | not occurred | none | good | Acceptable Example |
| 6 | Cu-4%Sn-0.03%P | 0.20 | 12.0 | primary solid particles + granular cyrstal | occurred | small formation | good | Comparative Example |
| 7 | Cu-6%Sn-0.10%P | 0.30 | 11.0 | primary solid particles + granular crystal | occurred | small formation | good | Comparative Example |
| 8 | Cu-6%Sn-0.10%P | 0.10 | 6.0 | primary solid particles + fine granular crystal | not occurred | none | good | Acceptable Example |
| 9 | Cu-10%Sn | 0.20 | 3.0 | primary solid particles + | not | none | good | Acceptable |

TABLE 6-continued

| Sample No. | Alloy to be tested | Solid fraction | Thickness (mm) | Solidification structure | Tin sweat | Formation of coarse δ-phase | Castability | Remarks |
|---|---|---|---|---|---|---|---|---|
| | | | | fine granular crystal | occurred | | | Example |
| 10 | Cu-14%Sn | 0.20 | 3.0 | primary solid particles + fine granular crystal | not occurred | none | good | Acceptable Example |
| 11 | Cu-20%Sn | 0.20 | 3.0 | primary solid particles + fine granular crystal | not occurred | slight formation | good | Acceptable Example |
| 12 | Cu-25%sn | 0.20 | 3.0 | primary solid particles + fine granular crystal | occurred | great formation | good | Comparative Example |

As to the phosphor bronze alloys of Table 6, in Sample Nos. 2, 3, 5 and 8 (acceptable examples), the solidification structure is a mixed structure consisting of primary solid particles and fine granular crystal, and the occurrence of tin sweat and the formation of coarse δ-phase are not observed, and the castability is good. On the contrary, in Sample No. 1 having a solid fraction of 0% (complete molten metal), the solidification structure is comprised of coarse columnar crystal and the tin sweat occurs and the formation of coarse δ-phase is observed. Furthermore, in Sample No. 4 having a solid fraction of 0.45, the fluidity of the semi-solidified metal slurry is poor and the casting can not be conducted, while in Sample Nos. 6, 7 (thickness exceeds 10 mm), the solidification structure is a mixed structure consisting of primary solid particles and coarse granular crystal (larger than the granular crystal in the acceptable examples), so that the occurrence of tin sweat can not be controlled and the formation of coarse δ-phase is somewhat observed.

Moreover, in the acceptable examples on the phosphor bronze alloy according to the invention, when final products are obtained by subjecting to soaking treatment, cold rolling and the like according to the usual manner, the quality is confirmed to be substantially the same as in the case of being subjected to grinding over full surface.

As to the high Sn copper alloy, in Sample Nos. 9 (Sn: 10%) and 10 (Sn: 14%) having a Sn content of not more than 14 wt %, the solidification structure is a mixed structure consisting of primary solid particles and fine granular crystal likewise the acceptable examples of the phosphor bronze alloy, and the occurrence of tin sweat and the formation of coarse δ-phase are not observed, and the castability is wherein Sample No. 11 wherein the Sn content is increased to 20 wt %, the coarse δ-phase is slightly observed, but the thin cast sheet may be rendered into a final product by soaking treatment and cold rolling. However, in Sample No. 12 wherein the Sn content is further increased to 25 wt %, a great amount of the coarse δ-phase is formed and the cracking is frequently caused in the cold rolling and the final product can not be obtained.

Therefore, the Sn content is preferably not more than 20 wt %.

INDUSTRIAL APPLICABILITY

According to the invention, the production of thin cast sheets having an excellent quality by the continuous casting of the semi-solidified metal slurry becomes easy. Furthermore, the following effects are obtained by producing thin cast sheets from various metal materials according to the invention, so that the invention is very useful in the production of sheet products made from the respective metal materials.

① Austenitic stainless steel

Thin sheets of austenitic stainless steel having no surface cracking can be produced, and the product yield can largely be improved to considerably reduce the cost.

② Boron-containing austenitic stainless steel

In the boron-containing austenitic stainless steel hardly subjected to hot working, the production of thin cast sheets having a good workability becomes easy and the hot working can be omitted, so that the production of thin sheets is very easy and the effect is tremendous.

③ Ferritic stainless steel

The production of raw material for ferritic stainless steel thin sheets causing no ridging in the forming work of the thin sheet becomes easy, and the yield in the forming work of the thin sheet is improved and also the cost is largely reduced.

④ Martensitic stainless steel

The thin cast sheet of martensitic stainless steel having no formation of coarse carbide can easily be produced, so that the production of thin sheet products having a high quality and a low cost can be realized.

⑤ Silicon steel

The thin cast sheet of silicon steel having a fine granular structure without segregation, a good internal quality finely dispersing precipitates of MnS and the like, and less surface cracking and work cracking can be produced, so that the effect of decreasing the temperature of solution treatment at the production step of grain oriented electromagnetic steel sheet and the effect of improving the electromagnetic properties as an electromagnetic steel sheet can be expected, and also the production of 6.5% Si thin steel sheet, which has been produced at complicated steps in the conventional technique, becomes easy.

⑥ Phosphor bronze alloy and high Sn copper alloy

The thin cast sheets of phosphor bronze alloy and high Sn copper alloy having good quality without tin sweat and work cracking can be produced. Furthermore, the grinding treatment is not substantially required, so that the improvement of product yield and the simplification of steps can be attained, and the cost can largely be reduced.

We claim:

1. A method of producing thin cast sheets by continuous casting in a continuous production device which comprises:

providing a molten metal;

feeding said molten metal continuously into an upper port of said continuous production device, said continuous production device also having a bottom portion;

agitating said molten metal in said continuous production device;

cooling said molten metal during said agitating to form in said continuous production device a semi-solidified metal slurry having a solid fraction of 0.01–0.40, said semi-solidified metal slurry comprising a solid-liquid mixed phase in which fine non-dendritic primary solid particles are suspended; and feeding said semi-solidified metal slurry through a discharge nozzle arranged at said bottom portion of said continuous production device, said nozzle being heated through high frequency induction utilizing a frequency of 40–200 kHz so that not less than 80% of an induction current is applied to said nozzle;

casting said semi-solidified metal slurry from said nozzle onto a twin roll type continuous strip caster wherein said slurry is rapidly quenched and cast to form a thin cast metal sheet having a fine structure and a dispersed precipitate therein.

2. A method of producing thin cast sheets by continuous casting as claimed in claim 1, wherein said agitated is effected by an electromagnetic agitating system.

3. A method of producing thin cast sheets by continuous casting as claimed in claim 1, wherein said agitated agitation is effected by an agitator rotating system.

4. A method of producing thin cast sheets by continuous casting as claimed in claim 1, wherein said discharge nozzle is made from alumina graphite having a specific resistance of 5000 μΩ·cm–12000 μΩ·cm.

5. A method of producing thin cast sheets by continuous casting as claimed in any one of claims 1–3 or 4, wherein said thin cast metal sheet has a thickness of not more than 10 mm.

6. A method of producing thin cast sheets by continuous casting as claimed in any one of claims 1–3 or 4, wherein said step of producing a molten metal comprises producing an austenitic stainless steel containing P and S so that said thin cast metal sheet exhibits a fine dispersion of P and S.

7. A method of producing thin cast sheets by continuous casting as claimed in any one of claims 1–3 or 4, wherein said step of producing a molten metal comprises producing a boron-containing austenitic stainless steel containing B: 0.5–4.0 wt %, P and S so that said thin cast metal sheet exhibits a fine dispersion of P, S and B in the form of boride.

8. A method of producing thin cast sheets by continuous casting as claimed in any one of claims 1–3 or 4, wherein said step of producing a molten metal comprises producing a ferritic stainless steel so that the formation of columnar crystal in said thin cast metal sheet is prevented.

9. A method of producing thin cast sheets by continuous casting as claimed in any one of claims 1–3 or 4, wherein said step of producing a molten metal comprises producing a martensitic stainless steel so that said thin cast metal sheet exhibits a fine dispersion of carbide.

10. A method of producing thin cast sheets by continuous casting as claimed in anyone of claims 1–3 or 4, wherein said step of producing a molten metal comprises producing a silicon steel containing Si: 3.0–6.5 wt % and Mn: not more than 2.5 wt % so that said thin cast metal sheet exhibits a fine structure and fine dispersion of an Mn-containing compound.

11. A method of producing thin cast sheets by continuous casting as claimed in any one of claims 1–3 or 4, wherein said step of producing a molten metal comprises producing a phosphor bronze alloy containing Sn: 3.5–9.0 wt % and P: 0.03–0.35 wt % so that the formation of columnar crystal and fine structure in said thin cast metal sheet is prevented.

12. A method of producing thin cast sheets by continuous casting as claimed in any one of claims 1–3 or 4, wherein said step of producing molten metal comprises producing a high Sn copper alloy containing Sn: 8–20 wt % so that the formation of columnar crystal and fine structure in said thin cast metal sheet is prevented.

13. A method or producing thin cast sheets by continuous casting as claimed in claim 1, wherein said nozzle has a wall thickness of 15–40 mm.

* * * * *

UNITED STATES PATENT AND TRADEMARK OFFICE

CERTIFICATE OF CORRECTION

PATENT NO. : 5,697,425

DATED : December 16, 1997

INVENTOR(S) : Akihiko Nanba, et al

It is certified that error appears in the above-indentified patent and that said Letters Patent is hereby corrected as shown below:

In column 5, line 10, please insert --side-- after "every"; and line, 64, please change "line" to --fine--.

In column 7, line 20, please delete "the".

In column 19, table 4, at the heading "Cast structure", at "Sample No. 3", please insert --fine-- before "granular".

In column 21, table 5, please change the heading "Degree of surface carking" to "Degree of surface cracking"; at the heading "Cast structure", at "Sample No. 10", please delete "occur"; and at the heading "Degree of surface cracking" at "Sample No. 10", please insert --occur-- after "frequently".

UNITED STATES PATENT AND TRADEMARK OFFICE

CERTIFICATE OF CORRECTION

PATENT NO. : 5,697,425

DATED : December 16, 1997

INVENTOR(S) : Akihiko Nanba, et al

It is certified that error appears in the above-identified patent and that said Letters Patent is hereby corrected as shown below:

In column 25, Claim 2, line 2, please change "agitated" to --agitating--; and

Claim 3, line 2, please change "agitated" to --agitating-- and delete "agitation".

Signed and Sealed this

Tenth Day of March, 1998

Bruce Lehman

*Attest:*

BRUCE LEHMAN

*Attesting Officer*

*Commissioner of Patents and Trademarks*